US005141341A

United States Patent [19]

Koyama et al.

[11] Patent Number: 5,141,341

[45] Date of Patent: Aug. 25, 1992

[54] WIRE DOT PRINT HEAD HAVING A BIPARTITE PARTITIONING SHEET

[75] Inventors: Tatsuya Koyama; Katsuya Kamimura; Kiyoshi Ikeda, all of Tokyo, Japan

[73] Assignee: Oki Electric Industry Co., Ltd., Tokyo, Japan

[21] Appl. No.: 644,975

[22] Filed: Jan. 23, 1991

[30] Foreign Application Priority Data

Jan. 23, 1990 [JP] Japan ..... 2-5548[U]

[51] Int. Cl.[5] ..... B41J 2/24

[52] U.S. Cl. ..... 400/124; 101/93.05

[58] Field of Search ..... 400/124; 101/93.05; 428/689

[56] References Cited

U.S. PATENT DOCUMENTS

| | | | |
|---|---|---|---|
| 4,244,658 | 1/1981 | Mori | 400/124 |
| 4,272,748 | 6/1981 | Fugate et al. | 335/271 |
| 4,674,896 | 6/1987 | Yasunaga et al. | 400/124 |
| 4,692,043 | 9/1987 | Ando et al. | 400/124 |
| 4,995,574 | 2/1991 | Cattaneo | 400/124 |

FOREIGN PATENT DOCUMENTS

| | | | |
|---|---|---|---|
| 0126760 | 5/1988 | Japan | 400/124 |

OTHER PUBLICATIONS

Patent Abstracts of Japan, vol. 13, No. 591 (M-913), Dec. 26, 1989, JP-A-1 249 357.

Patent Abstracts of Japan, vol. 10, No. 265 (M-515), Sep. 10, 1986, JP-A-61 089.

Patent Abstracts of Japan, vol. 6, No. 120 (M-140), Jul. 3, 1982, JP-A-57 047 672.

*Primary Examiner*—Edgar S. Burr
*Assistant Examiner*—Christopher A. Bennett
*Attorney, Agent, or Firm*—Wenderoth, Lind & Ponack

[57] ABSTRACT

In a wire dot print head, swinging members are formed of plate springs and armatures, which are attracted toward a core to resiliently deform a plate spring when an associated coil is not energized, and are released and moved forward when the coil is energized. The swinging members are swung about the forward tip ends of fulcrum members. A partition sheet is interposed between the rear surfaces of the swinging members and both the front ends of the cores and the front tip ends of the fulcrum members to interrupt transfer of grease, and to prevent direct contact of the cores and the fulcrum members with the armatures. The partition sheet includes a front plastic film, a metallic residual sheet, and a rear plastic film which are stacked in the stated order from the front side to the rear side of the print head. The front film is bonded to the metallic residual sheet over the entire surface of the metallic residual sheet. By bonding the front film and the metallic residual sheet, migration of the grease from the rear side to the front side of the partition sheet is prevented, and adhesion of the grease to the plate springs is also prevented. Moreover, because of the bonding, the metallic residual sheet is prevented from contacting the air and hence from rusting.

9 Claims, 5 Drawing Sheets

WIRE DOT PRINT HEAD HAVING A BIPARTITE PARTITIONING SHEET

BACKGROUND OF THE INVENTION

The present invention relates to a wire dot print head, and more particularly to a wire dot print head provided with a metallic residual sheet.

Impact printers are known in which, according to print information, print wires are driven so that the tips of the print wires are pressed against the print medium to effect printing. In such an impact printer, a wire dot print head of the plunger type, of the spring charge type, of the clapper type or the like is used.

FIG. 1 is a sectional view showing an example of a prior art spring charge type print head. In FIG. 1, print wires 1 are fixed to tips of armatures 2 and are moved toward and away from a platen PL. When the print wires 1 are moved forward, i.e., toward the platen PL, the tips 1*a* of the wires press the ink ribbon IR against a printing paper PP passing over the platen PL, thereby printing dots on the printing paper PP.

It is noted here that the terms "forward" and "front" in connection with the print head are used to mean "toward the platen" and "the side facing or closer to the platen". The terms "rearward" and "rear" are used to mean "away from the platen" and "the side facing opposite to or farther from the platen".

The armatures 2 are disposed between radial parts 4*a* of a front yoke which also has an annular part 4*b* to which the outer ends of the radial parts 4*a* are connected. The armatures 2 are mounted to inner ends 3*c* of radial parts 3*a* of a biasing plate spring 3, having its annular base part 3*b* clamped between an annular spacer 5 and an annular hinge plate 6, so as to form respective swinging members. The armatures 2 are normally magnetically attracted to cores 9. The magnetic attraction force is generated in the core 9 due to a magnetic flux generated by an annular permanent magnet 7 and passing through a generally cup-shaped rear yoke 8 comprising a disk-shaped base 8*b* and a cylindrical side wall 8*c*.

Each of the radial parts 3*a* of the plate spring 3 functions as a plate spring independently of the other radial parts, and so each radial part 3*a* can be referred to as a plate spring.

The cylindrical side wall 8*c*, the annular permanent magnet 8, the annular hinge plate 6, the annular part 3*b* of the plate spring 3, the annular spacer 5, and the annular part 4*b* of the front yoke 4 form an annular wall of the print head, while the disk-shaped base 8*b* of the rear yoke 8 forms the bottom wall of the print head.

A guide member comprises a flange part 40*a* connected to the annular part 4*b*, and a nose part 40*b* provided with guide conduit 40*c* with notches 40*d* at which wire guides 16 are received. Each of the wire guides 16 has holes through which the print wires 1 are passed such that they are slidably guided for movement toward and away from the platen PL.

Cores 9 extend from the front surface 8*d* of the disk-shaped base 8*b* of the rear yoke 8. Fulcrum members 8*a* also extend from the front surface 8*d* of the disk-shaped base 8*b* of the rear yoke 8. As is better illustrated in FIG. 2, the fulcrum members 8*a* are provided in association with respective cores 9 and are disposed between the associated cores 9 and the annular wall of the print head.

A demagnetizing coil 10 is wound on each of the cores 9 to form an electromagnet, and when a demagnetizing current is made to flow through the demagnetizing coil 10, the electromagnet generates a magnetic flux canceling the magnetic flux due to the permanent magnet 7. Because the magnetic force, which attracts the armature 2 to the core 9 thereby bending the radial part 3*a*, diminishes, the swinging member swings forward moving the armature 2 toward the platen PL because of the resilient force of the plate spring. Due to the swinging, the print wire 1 moves forward of the print head, being guided by the wire guides 16, and strikes the ink ribbon IR and the printing paper PP to effect printing.

Energization of the demagnetizing coil 10 is terminated at an appropriate time, and a rebounding force caused by the impact on the platen PL acts on the print wire 1. Accordingly, the print wire 1 begins to return backward, i.e., away from the platen PL. Due to the magnetic flux from the permanent magnet 7, the armature 2 is again magnetically attracted to the core 9, and a printing operation of one cycle is thus completed.

The swinging motion of the swinging member made about the tip 8*e* of the fulcrum member 8*a*, and so sliding friction is generated at the tip 8*e*. At the time of returning, the armature 2 collides, and so wear due to collision occurs on the core 9. In order to the prevent the wear, a partition sheet including a circular metallic residual sheet 13 is inserted between the core 9 and the plate spring 3, as shown in FIG. 1. Moreover, a front plastic film 14 is inserted between the metallic residual sheet and the radial parts 3*a*. More specifically, as shown in FIG. 4, an exploded view, the front plastic film 14 is circular, has the same diameter as the metallic residual sheet 13, and is superposed with the metallic residual sheet 13 to cover the entirety of the front surface of the metallic residual sheet 13. A rear plastic film 15 is inserted between the metallic residual sheet 13 and the tips 8*e* of the fulcrum members 8*a*. More specifically, as shown in FIG. 3, the rear plastic film 15 is annular, has the same outer diameter as the metallic residual sheet 13, and is superposed with the metallic sheets 13 to cover the entire peripheral part of the rear surface of the metallic residual sheet 13. The metallic residual sheet 13 is formed of a magnetic material, such as silicon steel containing 1% of silicon. The plastic films 14 and 15 are formed of abrasion-resistant resinous material. The plastic films 14 and 15 have a thickness of several microns. They are therefore difficult to assemble. In order to keep them in the desired shape during assembly, plastic rings 14*a* and 15*a* are bonded to the edges of the plastic films 14 and 15.

Furthermore, as shown in FIG. 3, being a partial sectional view of a main part of the print head, lubricating fluid such as grease 20 for lubrication is applied on the tip 8*e* of the fulcrum member 8*a* and the core 9 which face the radial parts 3*a* to prevent the wear of these parts.

Because of the repeated application of heat and vibration accompanying the printing operation, grease 20 may penetrate between the rear film 15 and the residual sheet 13, and then between the residual sheet 13 and the front film 14, following the path indicated by arrows Pa and Pb in FIG. 3. If a pinhole is formed in the front film 14 due to wear, the grease 20 may ooze out as indicated by arrow PC, and enter the space between the plate spring 3 and the front film 14, and may adhere to the plate spring 3. Thus, a sticking due to grease occurs. The sticking will act as a load when the armature 2 swings during printing. Accordingly, when such sticking occurs, the pixels are not fully printed.

The metallic residual sheet is formed of a ferromagnetic material, and very easily rusts. The metallic residual sheet is therefore given a rust-proof treatment. But the required accuracy of the thickness of the residual sheet is very high, and when the variation in thickness of the metallic residual sheet is on the order of several microns, the operation characteristic of the print head are adversely affected. For this reason, it is difficult to perform a complete rust-proof treatment. When, therefore, the humidity is high, or the residual sheet is touched by hand during assembly of the print head, leaving a fingerprint, the life of the print head is shortened.

SUMMARY OF THE INVENTION

The invention has been made in view of the above, and an object of the invention is to prevent adherence of the grease to the plate spring, and rusting of the metallic residual sheet.

A wire dot print head according to the invention is for printing on a print medium placed on a platen, and comprises:

a print wire;

a plate spring;

an armature which is fixed to the plate spring, and to which the print wire is fixed such that it can be moved toward and away from the platen;

a wire drive member including a core for attracting the armature to the core;

said wire drive member further comprising a coil which is wound on the core and which, when energized, generates a magnetic flux in the core;

wherein a partition sheet is inserted between the plate spring and the core;

said partition sheet comprises a front plastic film, a metallic residual sheet, a rear plastic film which are stacked in the stated order from the side of the plate spring to the side of the core; and the front film is bonded to the metallic residual sheet over the entire surface of the metallic residual sheet.

By bonding the front film and the metallic residual sheet, migration of grease from one side to the other side of the partition sheet is prevented, and adhesion of the grease to the plate spring is also prevented. Moreover, because of the bonding, contact with the air is prevented, and rusting of the metallic residual sheet is prevented.

DETAILED DESCRIPTION OF THE PREFERRED EMBODIMENTS

Figure 1:
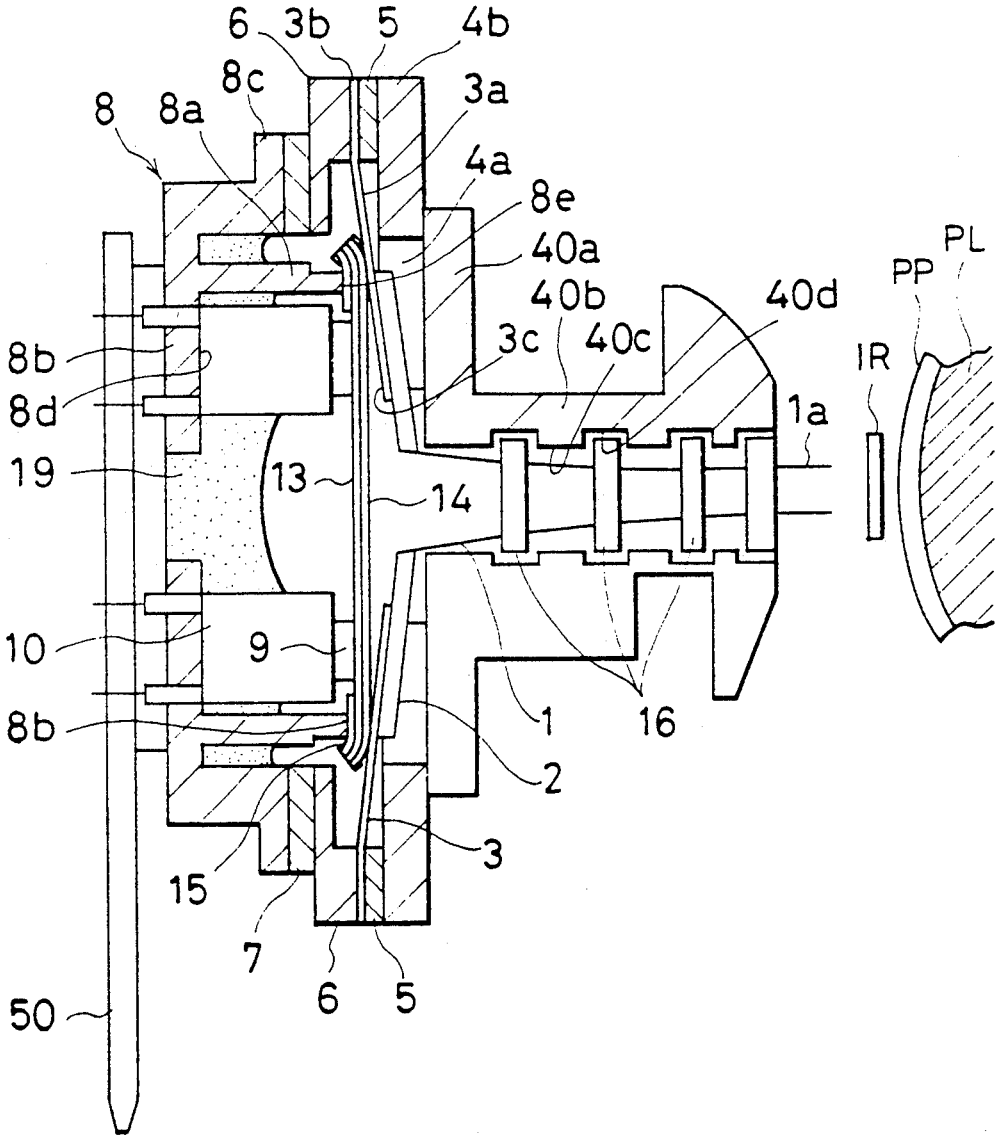
FIG. 1 PRIOR ART
FIG. 1 is a sectional view of a conventional spring-charge type wire dot print head.
Figure 2:
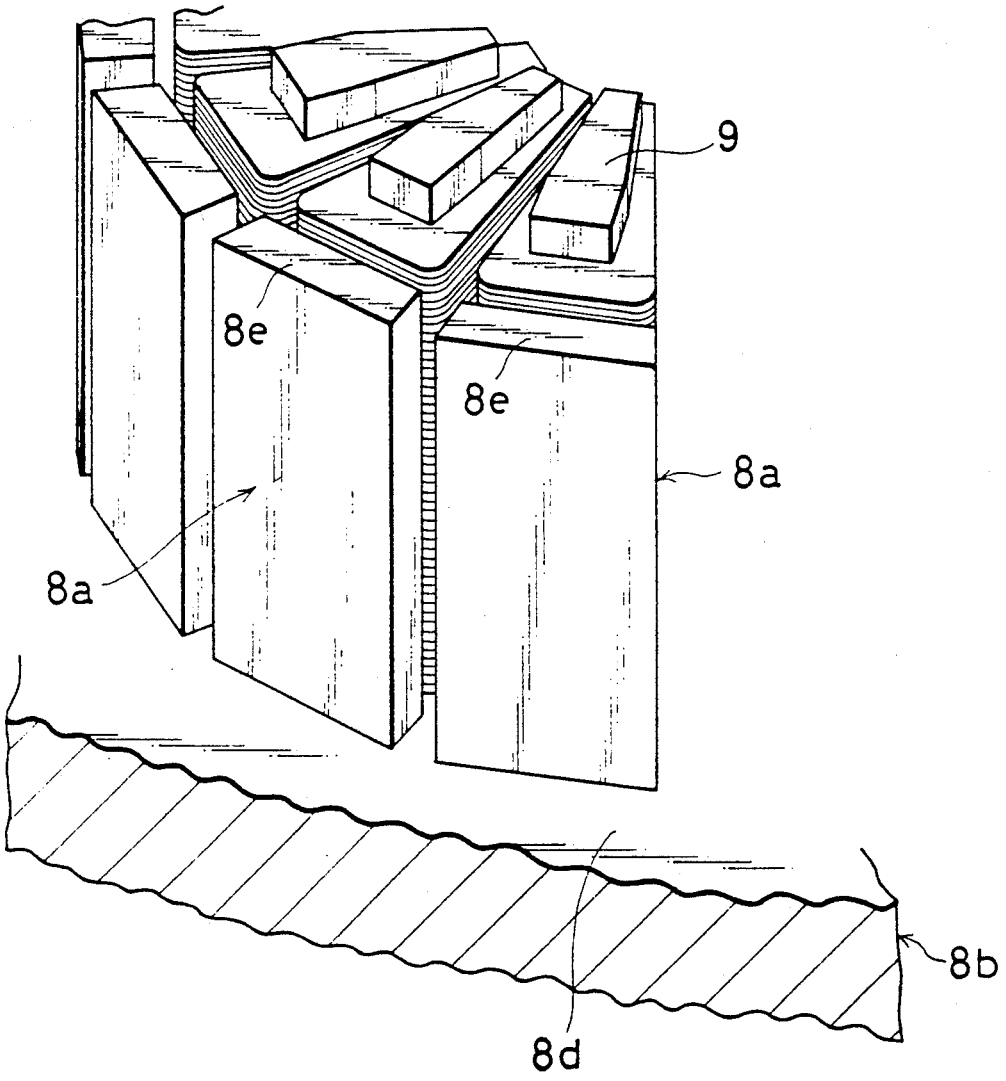
FIG. 2 PRIOR ART
FIG. 2 is a perspective view of part of the same showing fulcrum members.
Figure 3:
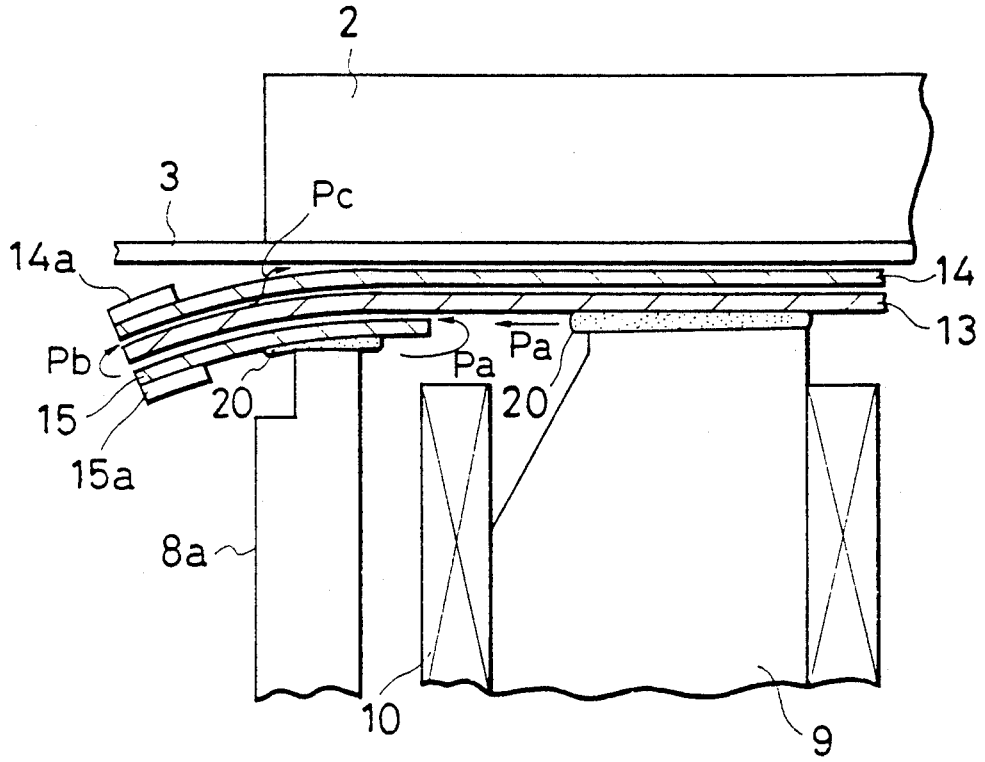
FIG. 3 PRIOR ART
FIG. 3 is a sectional view of a main part of the conventional wire dot print head.
Figure 4:
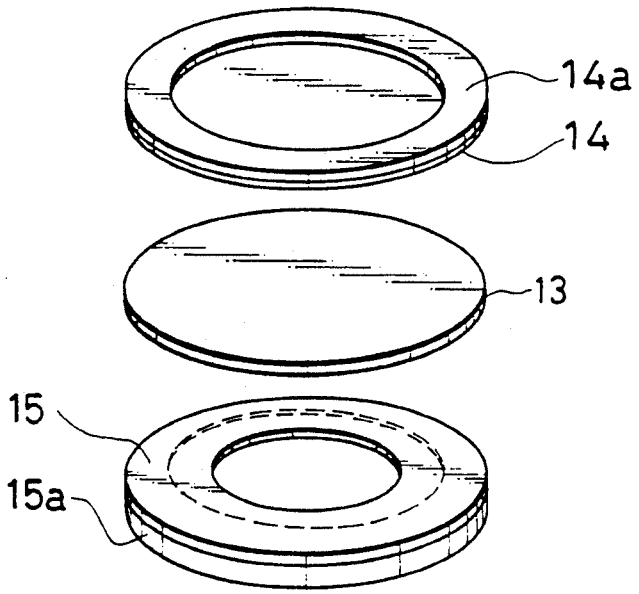
FIG. 4 PRIOR ART
FIG. 4 is an exploded view of a front film, a metallic residual sheet, and a rear film used in the conventional wire dot print head.
Figure 5:
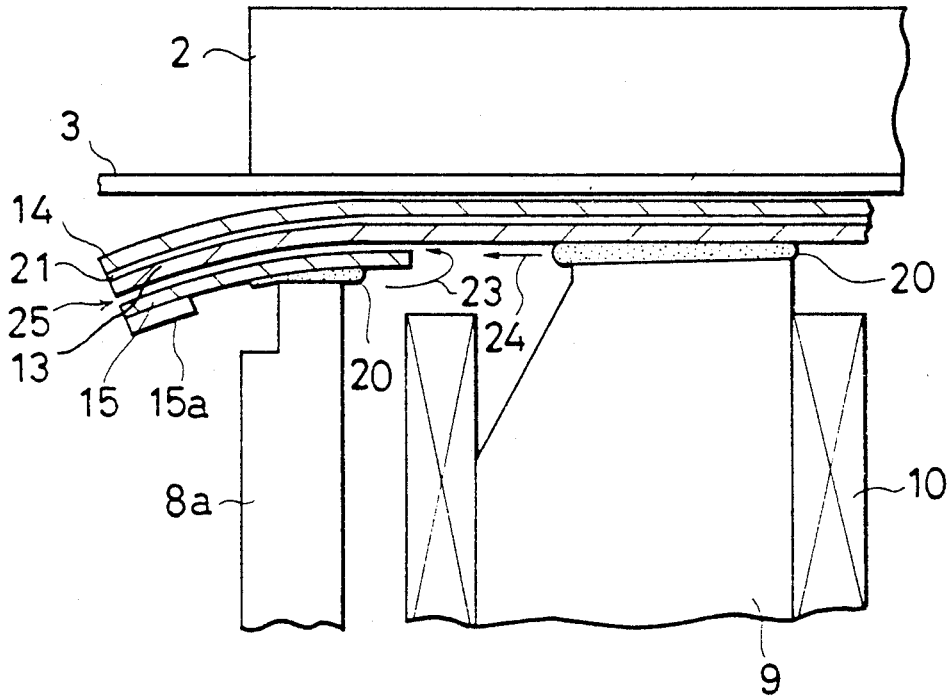
FIG. 5 is a sectional view of one embodiment of a main part of a wire dot print head according to the present invention.
Figure 6:
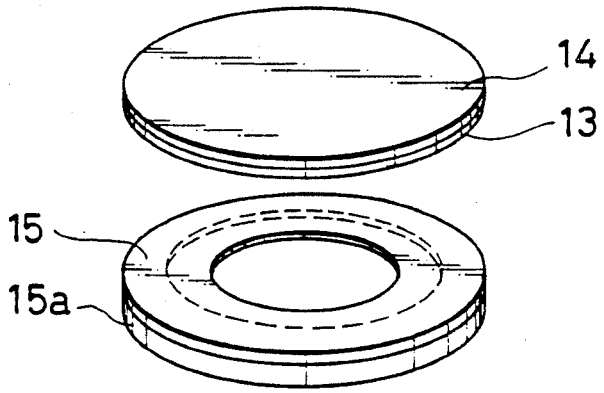
FIG. 6 is an exploded view of a front film, a metallic residual sheet, and a rear film according to the invention.
Figure 7:
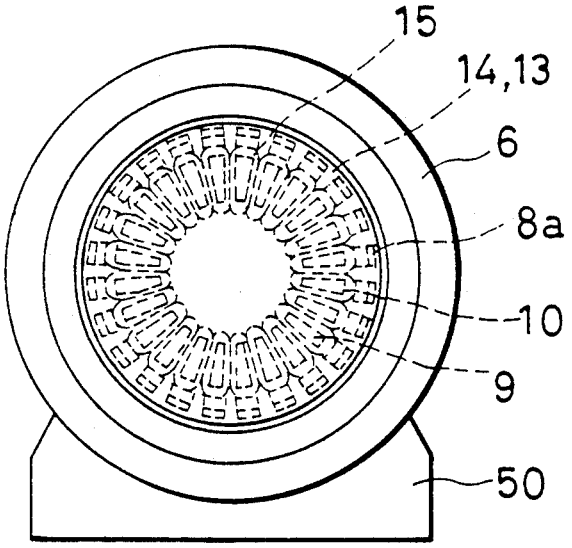
FIG. 7 is a sectional view of the main part of the wire dot print head of the embodiment of FIG. 5.

FIG. 5, FIG. 6 and FIG. 7 show an embodiment of the invention. As illustrated, the wire dot print head of this embodiment is similar to that shown in and described with reference to FIG. 1 to FIG. 3. The following description is directed mainly to the difference between the present invention and that of FIG. 1 to FIG. 3. The difference resides in the structure of the partition sheet.

In the partition sheet of this embodiment, the front film 14 and the metallic residual film 13 are bonded by an adhesive agent 21, such as heat-resistant epoxy adhesive agent, over the entire surfaces thereof. Such a configuration enables a method of fabrication in which the front film 14 and the metallic residual sheet 13 are bonded to each other in the form of raw materials, and are then cut into circular forms. Accordingly, compared with the prior art method in which the front film 14 and the metallic residual sheet 13 are made into circular forms separately and are then assembled together, the number of process steps is reduced, and the cost of production is lowered. Moreover, by being integrally bonded with the metallic residual sheet 13, the front film 14 maintains its circular form, and the plastic ring along the outer edge is no longer required. The rear film 15 remains unattached such that the partition sheet forms a bipartite structure.

In the partition sheet of the embodiment so constructed, the lubricating grease 20 penetrates into the interstice of the bipartite structure between the rear film 15 and the metallic residual sheet 13, due to a capillary phenomenon, as indicated by arrows 23 and 24 in FIG. 5. But, the front film 14 and the metallic residual sheet 13 are bonded by the adhesive agent 21, and so the grease cannot get inbetween the front film 14 and the metallic residual sheet 13. Accordingly, the grease that has migrated up to the peripheral edge of the metallic residual sheet 13, as indicated by arrow 25, cannot migrate further in a direction toward the plate spring 3. The ashesion of grease to the plate spring 3 is avoided, and good printing is therefore ensured.

Moreover, by bonding the metallic residual sheet to the front film 14, the front surface of the metallic residual sheet 13 does not contact the air and is therefore protected. Accordingly, rusting of the front surface of the metallic residual sheet can be prevented. On the other hand, the rear surface of the metallic residual sheet 13 is protected by the grease 20, and is prevented from rusting. Rusting of the metallic residual sheet 13 is thus avoided without the rust-proof treatment. The life of the print head is lengthened, and a stable printing operation is ensured for a long period.

As has been described above, according to the invention, the front film and the metallic residual sheet are bonded, and so grease does not penetrate between the metallic residual sheet and the front film, and the front surface of the metallic residual sheet is protected such that it does not contact the air. Accordingly, the grease that is applied to the rear side of the metallic residual sheet is prevented from migrating to the front side and adhering to the plate spring. Sticking due to the grease is eliminated, and an undesirable printing operation is prevented. Furthermore, the front surface of the metallic residual sheet is prevented from rusting, a shortening of the life of the print head due to rust is prevented, and a stable operation for a long period is ensured.

What is claimed is:

1. A wire dot print head comprising:

a print wire;

a plate spring supported in the print head so as to be swingable in forward and rearward directions;

an armature fixed to the plate spring, and to which armature the print wire is fixed such that the print wire can be moved in said forward and rear directions;

a wire drive member including a core for attracting the armature to the core, and a coil wound on the core, said core having a front surface facing toward said plate spring, and said coil generating a magnetic flux in the core when energized;

lubricating grease provided on the front surface of the core so as to prevent wear of said core and of said plate spring; and a partition sheet interposed between the plate spring and the core, said partition sheet comprising a front plastic film, a metallic residual sheet, and a rear plastic film stacked in the foregoing order from the plate spring toward the core, the front film being bonded to the metallic residual sheet over the entire surface of the metallic residual sheet, and the rear film and the metallic residual sheet being unattached to one another such that said partition sheet forms a bipartite structure defining an interstice between the metallic residual sheet and the rear film whereby any of the lubricating grease penetrating into said interstice is prevented from getting inbetween the front film and the metallic residual sheet.

2. A wire dot print head comprising:

an annular side wall including an annular permanent magnet;

a print wire extending in a forward direction in the print head;

a swinging member including a plate spring having a first end fixed to said side wall near the permanent magnet and a second end, and an armature fixed to the second end of said plate spring, a rear end of the print wire being fixed to said armature;

a core having a forward end adjacent to a rear surface of the armature;

a coil wound on the core;

a fulcrum member positioned between the permanent magnet and the core, and having a forward tip end adjacent to a rear surface of the armature;

said armature being attracted toward the core against a biasing force of the plate spring when the coil is not energized thereby resiliently deforming the plate spring;

said armature being released and moved in the forward direction under the biasing force of the plate spring when the coil is energized;

said swinging member having a rear surface facing toward the forward tip end of the fulcrum member so that the forward tip end of the fulcrum member forms a fulcrum point about which the swinging member will swing under the energization and deenergization of the coil;

lubricating fluid provided on both the forward end of the core and the forward tip end of the fulcrum member; and a partition sheet interposed between the rear surface of the swinging member and both the forward end of the core and the forward tip end of the fulcrum member to prevent the fluid from passing from the core and the fulcrum member to the plate spring and to prevent direct contact of the core and the fulcrum member with the plate spring, said partition sheet comprising a front plastic film, a metallic residual sheet, and a rear plastic film which are stacked in the foregoing order from the swinging member toward both the core and the fulcrum member, and the front film being bonded to the metallic residual sheet over the entire surface of the metallic residual sheet, and the rear film and the metallic sheet being unattached such that the partition sheet forms a bipartite structure defining an interstice between the metallic residual sheet and the rear film.

3. A print head according to claim 2, and further comprising a base connecting the permanent magnet and the core, and a front yoke having one end adjacent to the armature and having another end magnetically coupled to the permanent magnet.

4. A print head according to claim 3, wherein the fulcrum member extends from the base.

5. A wire dot print head comprising:

an annular side wall including an annular permanent magnet;

printing wires extending generally parallel with each other in a forward direction in the print head;

swinging members including armatures in association with the respective printing wires, and plate springs in association with the respective armatures, each of said plate springs having a first end fixed to the side wall near the permanent magnet and a second end fixed to a respective one of the associated armatures;

a rear end of each of the printing wires being fixed to a respective one of the associated armatures;

cores in association with the respective armatures, each of the cores having a forward end adjacent to a rear surface of a respective one of the armatures;

coils in association with the respective cores, each of the coils being wound on a respective one of the associated cores;

fulcrum members in association with the respective cores, each of said fulcrum members being positioned between the permanent magnet and a respective one of the associated cores, and having a forward tip end adjacent to a rear surface of a respective one of the associated armatures;

said annular permanent magnet extending around said armatures, said core, said plate springs and said fulcrum members;

each said armature being attracted toward the associated core against a biasing force of the associated plate spring when the associated coil is not energized thereby resiliently deforming the associated plate spring;

each said armature being released and moved in the forward direction by the biasing force of the associated plate spring when the associated coil is energized;

each said swinging member having a rear surface facing toward the forward tip end of a respective one of the fulcrum members so that the forward tip end of the fulcrum members each form a fulcrum point about which a respective one of the swinging members will swing under the energization and deenergization of the coils, respectively;

lubricating fluid provided on the forward ends of the cores and the forward tip ends of the fulcrum members; and a partition sheet interposed between the rear surfaces of the swinging members and both the forward ends of the cores and the forward tip ends of the fulcrum members to prevent the fluid from passing from the cores and the fulcrum members to the plate springs and to prevent direct contact of the cores and the fulcrum members with the plate springs;

said partition sheet comprising a front plastic film, a metallic residual sheet, and a rear plastic film which are stacked in the foregoing order from the swinging members toward both the cores and the fulcrum members, and the front film being bonded to the metallic residual sheet over the entire surface of the metallic residual sheet, and the rear film and the metallic sheet being unattached such that the partition sheet forms a bipartite structure defining an interstice between the metallic residual sheet and the rear film.

6. A print head according to claim 5, and further comprising a substantially disk-shaped base connecting the permanent magnet and the cores, and a front yoke having one end adjacent to the armatures and another end magnetically coupled to the permanent magnet.

7. A print head according to claim 6, wherein the fulcrum members extend forward from the base.

8. A print head according to claim 5, wherein said annular side wall extends around said print wires, said armatures, said plate springs, said cores and said fulcrum members.

9. A print head according to claim 5, wherein said partition sheet is interposed between the forward tip ends of said fulcrum members and rear surfaces of the plate springs.

* * * * *